US007412927B2

(12) United States Patent
Frank et al.

(10) Patent No.: US 7,412,927 B2
(45) Date of Patent: Aug. 19, 2008

(54) PRINTING MACHINE WITH GRIPPER RETRACTION MECHANISM FOR SAFE OPERATION OF THE PRINTING MACHINE

(75) Inventors: Hendrik Frank, Heidelberg (DE); Karl-Heinz Helmstädter, Heidelberg (DE); Jochen Bechtler, Malsch (DE); Stefan Maier, Bad Schönborn (DE); Matthias Nöll, Weiterstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 508 days.

(21) Appl. No.: 11/159,077

(22) Filed: Jun. 22, 2005

(65) Prior Publication Data

US 2005/0279233 A1 Dec. 22, 2005

Related U.S. Application Data

(60) Provisional application No. 60/583,258, filed on Jun. 25, 2004.

(30) Foreign Application Priority Data

Jun. 22, 2004 (DE) ..... 10 2004 030 142

(51) Int. Cl.
*B41F 21/04* (2006.01)

(52) U.S. Cl. ..... 101/409; 101/246

(58) Field of Classification Search ..... 101/246, 101/409, 230
See application file for complete search history.

(56) References Cited

U.S. PATENT DOCUMENTS

| | | | | |
|---|---|---|---|---|
| 4,475,459 | A | 10/1984 | Wanke et al. | 101/410 |
| 5,365,841 | A | 11/1994 | Uhrig | 101/212 |
| 6,089,157 | A | 7/2000 | Becker et al. | 101/230 |
| 6,659,008 | B2 * | 12/2003 | Mutschall et al. | 101/409 |
| 2002/0084581 | A1 * | 7/2002 | Schaum | 271/275 |
| 2002/0092432 | A1 | 7/2002 | Stephan | 101/230 |
| 2006/0260485 | A1 * | 11/2006 | Ohsawa | 101/230 |

FOREIGN PATENT DOCUMENTS

| | | |
|---|---|---|
| DE | 27 56 507 A1 | 6/1978 |
| DE | 30 49 067 C2 | 7/1982 |
| DE | 42 02 722 A1 | 8/1993 |
| DE | 197 52 680 A1 | 6/1999 |
| DE | 199 09 686 A1 | 9/2000 |
| DE | 201 02 712 U1 | 5/2001 |
| DE | 101 02 080 A1 | 7/2002 |
| GB | 434422 | 8/1935 |
| GB | 1 585 187 | 2/1981 |

* cited by examiner

*Primary Examiner*—Leslie J Evanisko
(74) *Attorney, Agent, or Firm*—Laurence A. Greenberg; Werner H. Stemer; Ralph E. Locher

(57) ABSTRACT

A process provides for the safe operation of a printing machine. The printing machine has a first cylinder driven by a first motor, and a second cylinder driven by a second motor. The first cylinder accepts sheets of paper from the second cylinder or delivers them to the second cylinder by a gripper system. In the case of a deviation in the synchronized running between the cylinders, the gripper system is retracted at least in part far enough into the first cylinder that the possibility of a collision of the gripper system with the second cylinder is eliminated.

6 Claims, 3 Drawing Sheets

PRINTING MACHINE WITH GRIPPER RETRACTION MECHANISM FOR SAFE OPERATION OF THE PRINTING MACHINE

CROSS-REFERENCE TO RELATED APPLICATION

This application claims the benefit under 35 U.S.C. § 119 (e), of U.S. Provisional Application No. 60/583,258, filed Jun. 25, 2004; this application also claims the priority, under 35 U.S.C. § 119, of German patent application No. 10 2004 030 142.5, filed Jun. 22, 2004; the prior applications are herewith incorporated by reference in their entirety.

BACKGROUND OF THE INVENTION

Field of the Invention

The invention relates to a process for the safe operation of a printing machine. The printing machine has a first cylinder driven by a first motor and a second cylinder driven by a second motor and the first cylinder accepts sheets of paper from the second cylinder or delivers them to the latter by a gripper system. Furthermore, the invention relates to a printing machine for the execution of the process. The printing machine has a first cylinder with a gripper system, a first motor for driving the first cylinder, a second cylinder, and a second motor for driving the second cylinder.

The invention results from the following background: sheet-fed printing machines contain cylinders with gripper systems for holding the sheets of paper. Some sheet-fed printing machines contain cylinders that are adjoining one another and are coupled to one another mechanically by a pair of toothed wheels such that the cylinders can be driven by a common motor. The pair of toothed wheels provides the cylinders with a positive coupling so as to ensure that the cylinders run synchronously with each other in all circumstances and to eliminate the possibility of a collision of a gripper system of one cylinder with the other cylinder.

However, there are also sheet-fed printing machines in which the cylinders do not have any such pair of toothed wheels and that are driven by different motors. As long as the motors work in a trouble-free manner, the synchronous motion of the cylinders is ensured and thus the possibility of a collision of the gripper system is eliminated. In order to avoid such a collision even in case of a malfunction of one of the motors or the malfunction of its control, additional precautionary measures are necessary.

These precautionary measures includes, for instance, in providing the safety device described in published, non-prosecuted German patent application DE 42 02 722 A1 (corresponding to U.S. Pat. No. 5,365,841). However, the process according to which this safety device works is not suitable for every printing machine.

A further prior art reference, published, non-prosecuted German patent application DE 199 09 686 A1 describes a device for controlling the grippers, wherein the grippers are swiveled below the periphery of an impression cylinder in order to be able to perform maintenance work.

SUMMARY OF THE INVENTION

It is accordingly an object of the invention to provide a process for the safe operation of a printing machine and a printing machine for the execution of the process which overcomes the above-mentioned disadvantages of the prior art methods and devices of this general type, in which collisions of the gripper system resulting from disturbances occurring in the printing operation are avoided and in order to create a suitable printing machine for the execution of the process. The process in accordance with the invention concerns the safe operation of a printing machine. The printing machine has a first cylinder driven by a first motor and a second cylinder driven by a second motor. The first cylinder accepts sheets of paper from the second cylinder or delivers them to the second cylinder by a gripper system. The method is characterized in that if a deviation in the synchronous running occurs between the cylinders, the gripper system is retracted, at least in part, and so far into the first cylinder that a collision of the gripper system with the second cylinder is avoided.

In the process in accordance with the invention, the retraction of the gripper system takes place if a preset rotational-angle difference is exceeded in which case the collision of the gripper system is possible.

The printing machine in accordance with the invention for the execution of the process contains a first cylinder with a gripper system, a first motor for driving the first cylinder, a second cylinder and a second motor for driving the second cylinder. The first cylinder has a retraction mechanism for the compulsory retraction of the gripper system into the first cylinder in case a deviation in the synchronous running occurs between both the cylinders.

In the printing machine in accordance with the invention, both the cylinders are decoupled from one another mechanically and either the entire gripper system including the gripper and the gripper pad or only a part of the gripper system, for instance only the gripper, is retracted so deep into the first cylinder that the possibility of the collision of the gripper system with the second cylinder is avoided.

In a first embodiment, the retraction mechanism contains first switchgear that rotates along with the first cylinder and second switchgear that rotates along with the second cylinder and is attached to it in such a manner that the switchgears come into a switching contact in case of a deviation in the synchronized running. As soon as the synchronized running between the cylinders is disturbed, even the synchronized running between the switchgears rotating along with the cylinders is disturbed. Following the transgression of a preset rotational-angle difference between the cylinders and thus between the switchgears, the latter come into a switching contact with each other.

In a second embodiment, the second switchgear has a first flank and a second flank that lie opposite to each other in the direction of rotation and are disposed with a clearance with respect to the first switchgear that retracts into the second-switchgear contactlessly during trouble-free synchronized running. As long as the rotational-angle difference between the switchgears that is preset by the clearance is not exceeded, the first switchgear retracts into the second switchgear during every rotation without coming into switching contact with any of the two flanks of the second switchgear.

In a third embodiment, the first switchgear is a switching lever that is disposed such that it can swivel in consequence of a switching contact between the switching lever and the first flank in the same direction of rotation as in consequence of a switching contact between the switching lever and the second flank. The switching lever and/or a cam follower that the switching lever features, and the flanks of the second switchgear are disposed and contoured with such coordination to one another that in both the cases, i.e. in case of the contact of the cam follower with the first flank and the contact of the cam follower with the second flank, the switching lever is pressed by the respective flank in one and the same direction.

In accordance with a fourth embodiment of the present invention, the second switchgear is a safety cam. The safety cam is disposed coaxially to the second cylinder and is connected to the latter in a torque-proof manner.

In a fifth embodiment of the present invention, the first switchgear is disposed for activating a control cam that controls the gripper system. The control cam serves as the so-called gripper opening cam during the trouble-free synchronized running in order to displace one gripper of the gripper system with respect to its gripper pad. Moreover, in case of a deviation in the synchronized running, it enables the gripper and the gripper pad to retract into the first cylinder for the purpose of avoiding a collision of the gripper with the second cylinder.

In accordance with a sixth embodiment of the present invention, during the trouble-free synchronized running, the control cam is supported by a cam support, which is disposed in such a manner that in case of a deviation in the synchronized running, the first switchgear, as a result of its switching contact with the second switchgear, hits against the cam support and thereby displaces it such that the cam support enables a displacement of the control cam. Accordingly, as a result of its switching contact, the first switchgear is displaced in such a manner with respect to the first cylinder that only after this occurrence, the cam support penetrates into an imaginary flight circle of the first switchgear, which is formed by the first switchgear as a result of its rotation taking place together with the first cylinder.

Other features which are considered as characteristic for the invention are set forth in the appended claims.

Although the invention is illustrated and described herein as embodied in a process for the safe operation of a printing machine and a printing machine for the execution of the process, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
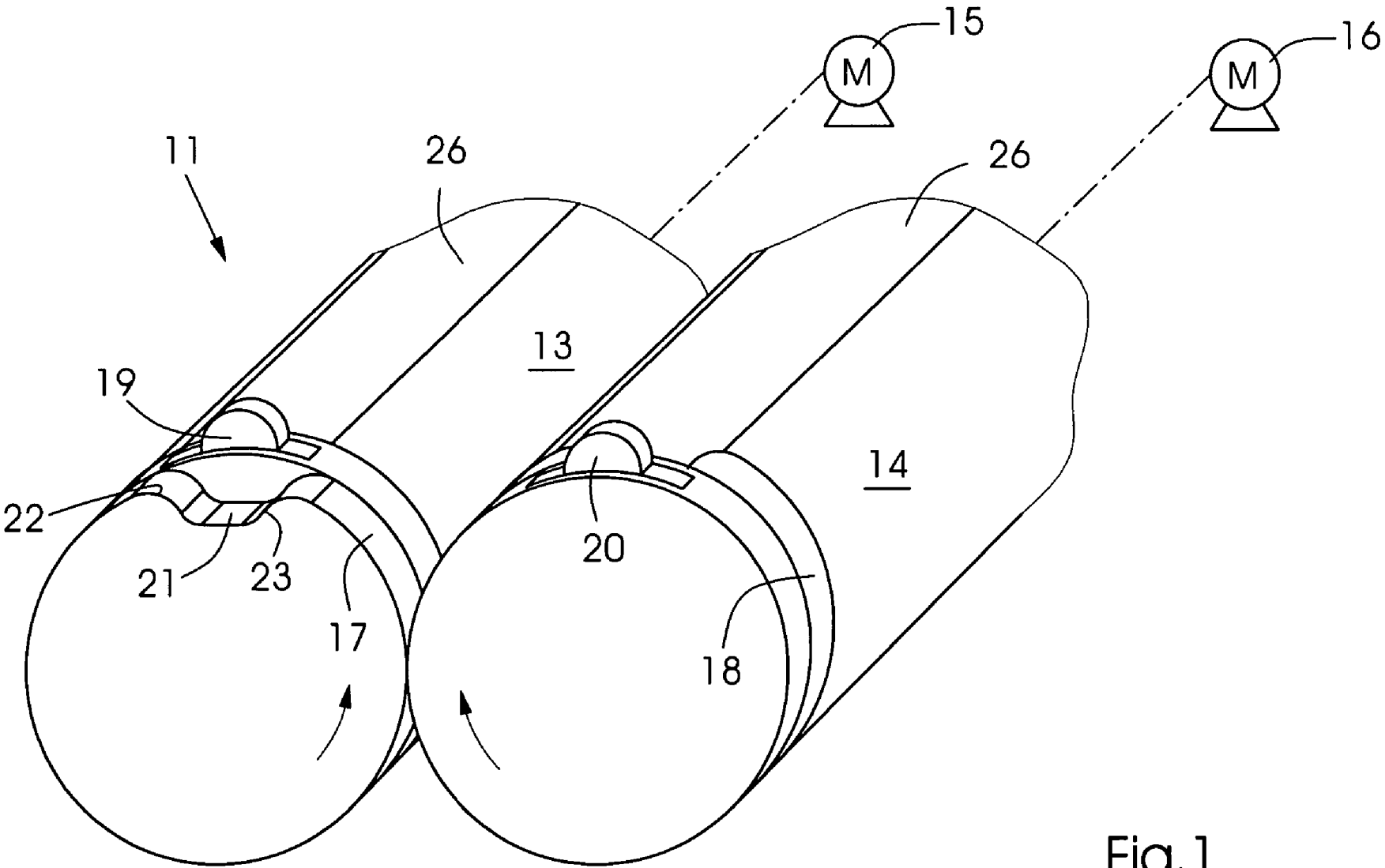
FIG. 1 is a diagrammatic, perspective view of a pair of cylinders used in printing machines according to the invention.

Referring now to the figures of the drawing in detail and first, particularly, to FIG. 1 thereof, there is shown a printing machine 11 which contains a first cylinder 13 and a second cylinder 14. Each cylinder 13, 14 is a cylinder transporting a sheet of paper 12 from a substrate to be printed, such as for instance, an impression cylinder or a transfer drum. The first cylinder 13 is driven rotatively by a first motor 15 and the second cylinder 14 is driven rotatively by a second motor 16.

Figure 2:
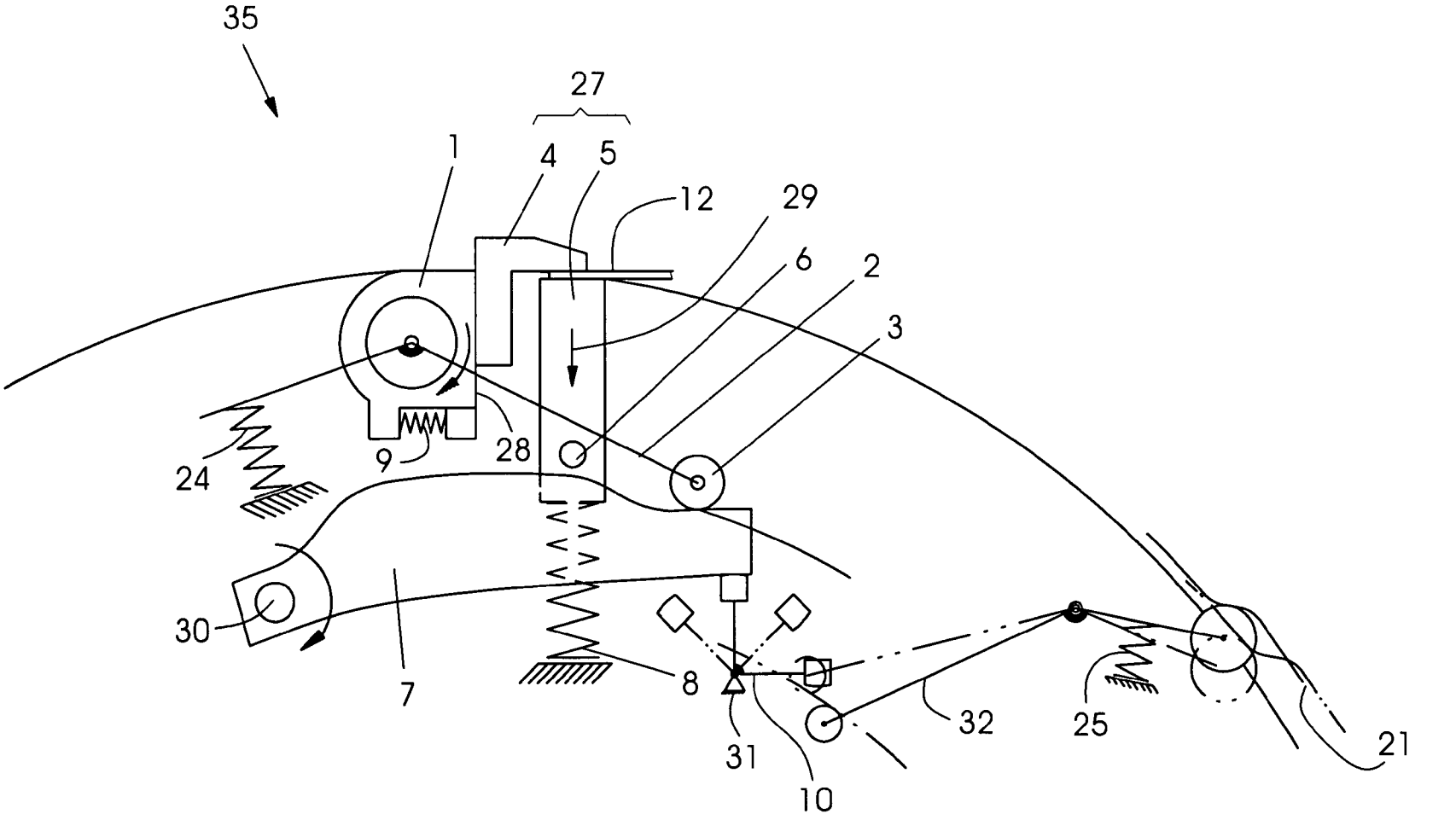
FIG. 2 is a detailed illustration of a retraction mechanism of a gripper system with which each cylinder of the pair of cylinders illustrated in FIG. 1 is equipped.

A first safety cam 17 and a first cam follower 19 are attached to the first cylinder 13 and a second safety cam 18 and a second cam follower 20 are attached to the second cylinder 14. The cam followers 19, 20 are rollers. Each safety cam 17, 18 has a depression 21 with a flank 22 that leads and a flank 23 that trails in the direction of rotation. Each cylinder 13, 14 has a cylinder gap 26 with a gripper system 27 disposed in it as shown in FIGS. 1 and 2.

Each of the gripper systems 27 contains a gripper 4 and a gripper pad 5 between which the sheet of paper 12 is clamped during the gripping process. During the gripping process of the sheet of paper 12, the gripper 4 is swiveled toward the gripper pad 5 by a gripper shaft 1. The closing of the gripper system 27 and also its opening are controlled by a cam mechanism that contains a roller lever 2 and a control cam 7. The roller lever 2 is connected to the gripper shaft 1 in a torque-proof manner and supports a cam roller 3 that is retained on the control cam 7 by a roller lever-spring 24.

The clamping force of the gripper 4 is determined by a gripper-spring 9, which is a pressure spring and is prestressed between a gripper housing 28 that is mounted on the gripper shaft 1 and connected firmly to the gripper 4 and a stop. The stop is connected firmly to the gripper shaft 1.

The gripper pad 5 is mounted in each of the cylinders 13, 14 in a substantially radial direction 29 such that it can be displaced inwards and it is stressed in the opposite direction by a gripper pad-spring 8. The gripper pad-spring 8 is stronger, i.e. it generates greater spring force than the gripper spring 9. A pencil-shaped tappet 6, which can be contacted by the roller lever 2, is disposed on the gripper pad 5.

The control cam 7 is connected to a machine frame 31 via a swivel joint 30 and is supported on its end that is opposite to the swivel joint 30 by a cam support 10. The cam support 10 is also connected to the machine frame 31 by a swivel joint and is displaceable by a switching lever 32 from a support position that is indicated by the continuous line in FIG. 2 into a release position that is indicated by the phantom line. On one of its ends, the switching lever 32 supports the respective cam follower 19, 20 and during the switching process it contacts the cam support 10 with its other end. The switching lever 32 is mounted in each of the cylinders 13, 14 by a swivel joint and is stressed by a return spring 25.

The function of the retraction mechanism 35 illustrated in FIG. 2 is explained in the following description of the design form, in which the retraction mechanism 35 is allocated to the first cylinder 1.

During the trouble-free synchronous running of the cylinders 13, 14, there exists no risk of the gripper system 27 of the first cylinder 13 colliding with the second cylinder 14. During every rotation of the cylinders, the first cam follower 19 meshes with the depression 21 of the second safety cam 18 without touching the latter in doing so. This cooperation of both the switchgears (switching lever 32, second safety cam 18) that is free of switching contact is ensured by the clearance that is present during the central intervention of the first cam follower 19 between the latter and the flanks 22, 23.

A disturbance in the synchronized running can occur for instance, in case of a breakdown of any of the motors 15, 16 and involves the risk of the gripper system 27 of the first cylinder 13 colliding with the second cylinder 14, because both the cylinders 13, 14 are not coupled to one another rotatively via a pair of toothed wheels that positively ensures the synchronized running of the cylinders. The risk of collision becomes acute in case a preset rotational-angle difference between the cylinders 13, 14 is exceeded.

In case of a disturbance in the synchronized running of the cylinders, the first cam follower 19 no longer retracts exactly into the center of the depression 21 and the first cam follower 19 no longer comes into a switching contact with the second safety cam 18. The arc length of the depression 21 and/or the distance between the flanks 22 and 23 is dimensioned in such a manner that if the preset rotational-angle difference is exceeded, the first cam follower 19 runs on to one or the other flank 22 or 23 depending on the direction of this deviation in the synchronized running.

Thus the switching lever 32 supporting the first cam follower 19 is deflected, and due to its configuration and the inclination of the flanks 22, 23 in both cases—i.e. in case of a contact with the leading flank 22 as well as in case of a contact with the trailing flank 23—in one and the same direction of oscillation, i.e. in the clockwise direction as regards FIG. 2.

Consequently, the switching lever 32 hits against the cam support 10 with its lever arm that is opposite to the first cam follower 19 and in doing so, presses it out of its support position so that the cam support 10 releases the control cam 7 and the latter, as regards FIG. 2, can be folded away downward.

The roller lever-spring 24 presses the gripper pad 5 via the roller lever 2 and the tappet 6 that is consequently contacted by the roller lever 2 against the effect of the gripper pad-spring 8 into the interior of the cylinder. As a result of the connected movement of the gripper shaft 1 and the effect of the gripper-spring 9, the gripper 4 follows the retraction movement of the gripper pad 5 so far till the gripper 4 can no longer collide with the second cylinder 14. The gripper system 27 remains in a permanently retracted form after the activation of the retraction mechanism throughout several rotations of the first cylinder 18 and until the deactivation of the retraction mechanism.

For the purpose of deactivating the retraction mechanism, the cam support 10, is displaced back into its support position, for instance, by a servo drive due to which the control cam 7 is folded upward and in doing so, the roller lever 2 is swiveled back by the control cam 7 against the effect of the roller lever-spring 24, such that the gripper pad-spring 8 can once again displace the gripper pad 5 against the direction 29.

The retraction mechanism is configured for retracting the gripper system 27 of the second cylinder 14 that works exactly as the above-described retraction mechanism for the retraction of the gripper system 27 of the first cylinder 13 that takes place if a rotational-angle difference occurring between the cylinders 13, 14 is exceeded. The retraction mechanism of the second cylinder 14 retracts its gripper system 27 into the interior of the cylinder in case of a disturbance in the synchronized running and/or a rotational-angle difference between the second cylinder 14 and a non-illustrated third cylinder. In doing so, the second cam follower 20 works together with a non-illustrated third safety cam of the third cylinder.

Figure 3:
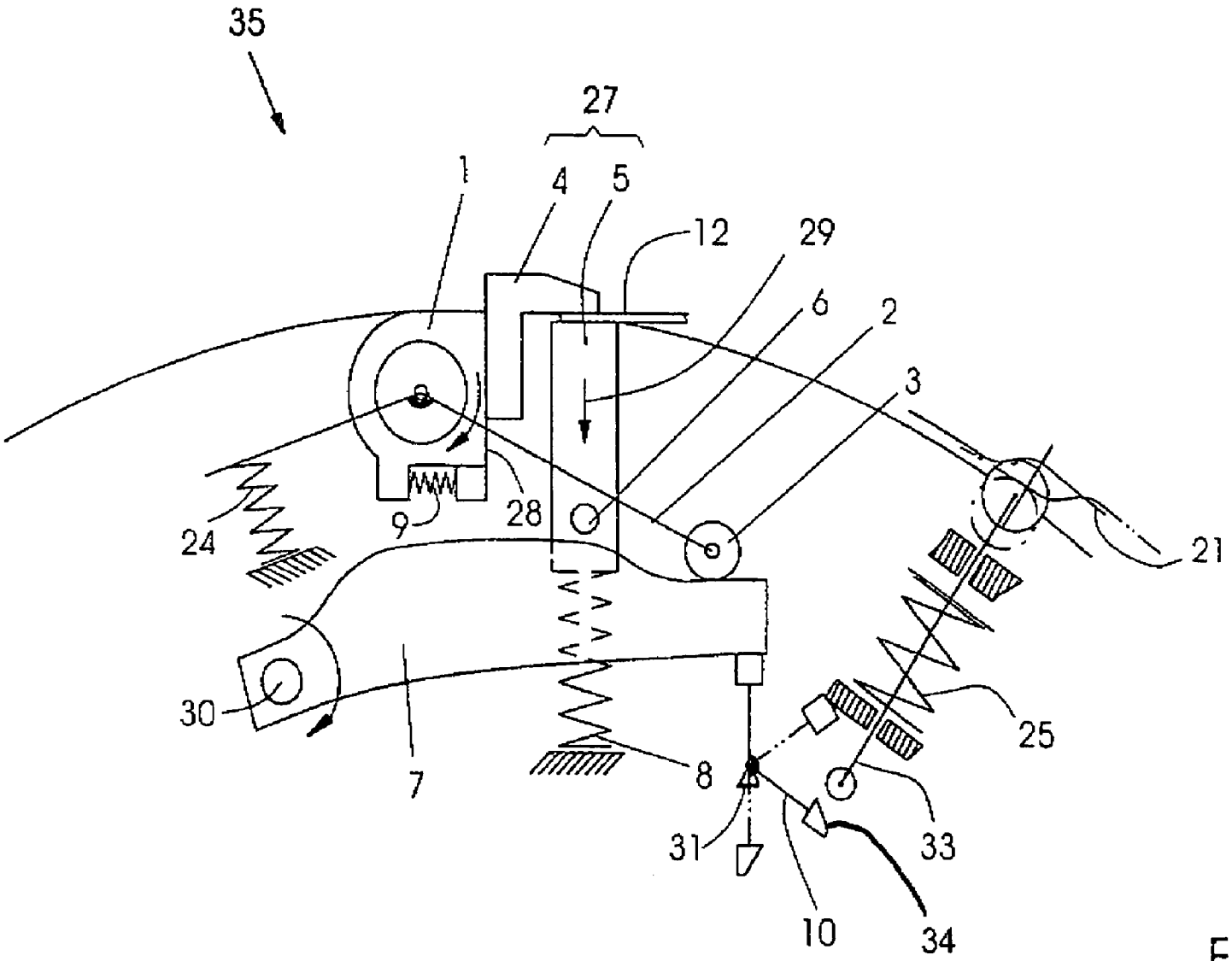
FIG. 3 is a detailed illustration of a modification of the retraction mechanism illustrated in FIG. 2.

The configuration form illustrated in FIG. 3 differs from the one in FIG. 2 only by the use of a switching valve 33 and/or a switching rod that comes into active connection with a wedge surface 34 for activating the cam support 10.

We claim:

1. A printing machine, comprising:

a first cylinder having a gripper system;

a first motor driving said first cylinder;

a second cylinder; and a second motor driving said second cylinder;

said first cylinder further having a retraction mechanism for compulsorily retracting said gripper system into said first cylinder in case of a deviation in a synchronized running between said first and second cylinders, said retraction mechanism containing a first switchgear configured for rotating along with said first cylinder and a second switchgear configured for rotating along with said second cylinder such that said first and second switchgears come into switching contact with one another in case of a deviation in the synchronized running of said first and second cylinders.

2. The printing machine according to claim 1, wherein said second switchgear has a first flank and a second flank that lie opposite one another in a direction of rotation and is formed with a clearance with respect to said first switchgear, said first switchgear retracts into said second switchgear without contact during a trouble-free synchronized running of said first and second cylinders.

3. The printing machine according to claim 2, wherein said first switchgear includes a switching lever that is disposed in such a manner that consequent to switching contact between said switching lever and said first flank, said switching lever can swivel in a same direction as in case of switching contact between said switching lever and said second flank.

4. The printing machine according to claim 1, wherein said second switchgear is a safety cam.

5. The printing machine according to claim 1, wherein said retraction mechanism includes a control cam controlling said gripper system, said first switchgear disposed for activating said control cam.

6. The printing machine according to claim 5, wherein said retraction mechanism contains a cam support, during trouble-free synchronized running of said first and second cylinders, said control cam is supported by said cam support disposed such that in case of deviation in the synchronized running, said first switchgear, as a result of its switching contact with said second switchgear, hits against said cam support and in doing so, displaces said cam support such that said cam support enables a displacement of said control cam.

* * * * *